US008639130B2

(12) United States Patent
Miura et al.

(10) Patent No.: US 8,639,130 B2
(45) Date of Patent: Jan. 28, 2014

(54) DEVELOPER STORAGE DEVICE

(75) Inventors: Yukihiro Miura, Toride (JP); Toshiyuki Harashima, Chichibu (JP)

(73) Assignee: Canon Kabushiki Kaisha, Tokyo (JP)

( * ) Notice: Subject to any disclaimer, the term of this patent is extended or adjusted under 35 U.S.C. 154(b) by 189 days.

(21) Appl. No.: 13/188,766

(22) Filed: Jul. 22, 2011

(65) Prior Publication Data

US 2012/0020683 A1 Jan. 26, 2012

(30) Foreign Application Priority Data

Jul. 23, 2010 (JP) ..... 2010-165839

(51) Int. Cl.
*G03G 15/08* (2006.01)

(52) U.S. Cl.
USPC ..... 399/27; 250/573; 250/576

(58) Field of Classification Search
USPC ..... 399/27; 250/573, 576
See application file for complete search history.

(56) References Cited

U.S. PATENT DOCUMENTS 5,465,139 A * 11/1995 Kimura et al. ..... 399/260
7,346,293 B2 * 3/2008 Suzuki et al. ..... 399/111
7,796,924 B2 * 9/2010 Amano et al. ..... 399/262

FOREIGN PATENT DOCUMENTS

JP 2004354524 12/2004

* cited by examiner

*Primary Examiner* — David Gray
*Assistant Examiner* — Michael Harrison
(74) *Attorney, Agent, or Firm* — Fitzpatrick, Cella, Harper & Scinto

(57) ABSTRACT

A developer accommodating apparatus includes a developer accommodating portion for accommodating a developer; developer detecting means, including a light receiving element for receiving light emitted by a light emitter, for detecting the developer in said developer accommodating portion; a cylindrical light guide member, provided projected from a side surface of said developer accommodating portion, for guiding the light emitted from said light emission element to said light receiving element; a rotatable member provided on a peripheral surface of said light guide member and rotatable about said light guide member; and driving means for rotating said rotatable member.

5 Claims, 17 Drawing Sheets

(a)

(b)

DEVELOPER STORAGE DEVICE

FIELD OF THE INVENTION AND RELATED ART

The present invention relates to an intermediary developer storage device equipped with a developer detecting means which detects the presence (or absence) of the developer in the intermediary developer storage device. In particular, it relates to the structure of an intermediary developer storage device which employs an optical sensor as the developer detecting means.

Some image forming apparatuses such as a copy machine, a facsimile machine, and a printer, are known to be structured to form an electrostatic latent image on an image bearing member, such as a photosensitive drum, with the use of an electrophotographic method, an electrostatic recording method, or the like, and develop the electrostatic latent image into a visible image with the use of the developer which the developing device of the apparatus contains. In the case of an image forming apparatus structured as described above, as the amount of the developer in its developing device is reduced below a preset value, by the development of an electrostatic latent image, replenishment developer is delivered into the developing device from a developer delivery device, or the cartridge in the apparatus, from which developer has been delivered to the developing device, is replaced. Incidentally, the term "developer" in the claim section and detailed description section of this patent application includes not only toner itself (single-component developer), but also, two-component developer made up of toner and magnetic carrier. Further, in a case where developer is two-component developer, replenishment developer may be toner alone, or mixture of toner and carrier.

In order to control the process of replenishing the developing device of an image forming apparatus with developer, or to replace the developer cartridge in the image forming apparatus, it is necessary to detect the presence (or absence) of the developer in the developer storing portion. Some developing devices are provided with a toner buffer, that is, a toner storage in which the toner delivered from a toner bottle is temporarily stored, and the wall of the toner buffer is provided with a piezoelectric sensor for detecting the amount of toner in the buffer, and/or simply the presence or absence of toner in the buffer. Further, some developing devices which are structured to use two-component developer are provided with a magnetism sensor, which is attached to the developer container to detect the presence or absence of the two-component developer, that is, the developer which contains magnetic carrier, in the developer container.

In the case of a small image forming apparatus, however, it is mostly an optical sensor that is used as the means for detecting the developer, because a small image forming apparatus is limited in the amount of space available for the developer sensor, and also, an optical sensor is simple in structure. For example, there is a developer sensing means which employs a light emitting element and a light sensing element (Japanese Laid-open Patent Application 2004-354524). The intermediary developer storage device which uses this developer sensing means is structured so that the light emitting element and light sensing element oppose each other in the recess of the developer storage portion. In the case of this structural arrangement, as long as the recess is full of developer, the light emitted by the light emitting element is blocked by the developer, and therefore, it is determined that developer is present in the developer storage portion. Also in the case of this structural arrangement, a cleaning member which cleans the inside of the recess by directly contacting the surface of the recess is provided.

In the case of the above described developer sensing means disclosed in Japanese Laid-open Patent Application 2004-354524, in order to ensure that the portion of the surface of the recess, through which the light from the light emitting element exits, and the portion of the surface of the recess, through which the light from the light emitting element enters to be guided to the light sensing element, is satisfactorily cleaned, a certain amount of pressure has to be applied to the cleaning member so that a certain amount of contact pressure is maintained between the cleaning member and the light exit portion and light entrance portion of the surface of the recess while the cleaning member is rubbing these portions of the surface of the recess. However, the actual storage portion of the intermediary developer storage device is formed of transparent resin such as PC (poly-carbonate) and PS (polystyrene). Therefore, as the light exit and entrance portions of the surface of the recess are rubbed by the cleaning member which is under a certain amount of pressure, it is possible that they will be scarred and/or become murky. Moreover, the light emitting element gradually reduces in output. Thus, toward the end of the service life of the intermediary developer storage device, it is likely for the optical sensor to make detection errors, because of the accumulation of the scars and the progression of the murkiness. Further, it is possible that as the cleaning member made of an elastic material rubs against the resin, of which the actual storage portion having the recess is made, the developer storage portion is charged up, causing the developer therein to be electrostatically adhered to the abovementioned portions of the surface of the recess.

One of the methods for dealing with the above described problem is to structure the developer detecting means so that the light exit surface and light entrance surface, which face each other, become perpendicular to the gravity direction. With the employment of this structural arrangement, developer is unlikely to remain adhered to the two surfaces, even if the two surfaces are not cleaned. In the case of this structural arrangement, in order to provide a proper distance between the light exit surface and light entrance surface to enable the developer detecting means to detect developer at a high level of accuracy, it is necessary that a light guide for guiding the light from the light emitting element is placed between light emitting element and light exit surface and between light sensing element and light entrance surface, or at least one of the two locations. However, this structural arrangement is problematic in that developer is likely to accumulate on the light guide itself. If the body of developer on the light guide is left unattended for a substantial length of time, the body of developer reduces in fluidity, and grows downward and hangs like an icicle on the light exit surface and/or light entrance surface, causing thereby the developer detecting means to make detection errors.

SUMMARY OF THE INVENTION

The present invention was made in consideration of the above described issue. Therefore, the primary object of the present invention is to provide an intermediary developer storage device which employs an optical sensor as its developer detecting means, and is structured so that the optical sensor is unlikely to make detection errors.

According to an aspect of the present invention, there is provided a developer accommodating apparatus comprising a developer accommodating portion for accommodating a developer; developer detecting means, including a light receiving element for receiving light emitted by a light emitter, for detecting the developer in said developer accommodating portion; a cylindrical light guide member, provided projected from a side surface of said developer accommodating portion, for guiding the light emitted from said light emission element to said light receiving element; a rotatable member provided on a peripheral surface of said light guide member and rotatable about said light guide member; and driving means for rotating said rotatable member.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 6(*a*) is a schematic vertical sectional view of the intermediary developer storage device and its adjacencies, and shows their structure; and FIG. 6(*b*) is a schematic cross-sectional view of the intermediary developer storage device, and shows their structure.

FIG. 15(*a*) is a schematic vertical sectional view of the intermediary developer storage device and its adjacencies, and shows their structure; and FIG. 15(*b*) is a schematic cross-sectional view of the intermediary developer storage device, and shows their structure.

FIG. 16(*a*) is the same as FIG. 14 except for the absence of the toner bottle; FIG. 16(*b*) is a schematic cross-sectional view of the light guide cover and its adjacencies in the fourth embodiment.

DESCRIPTION OF THE PREFERRED EMBODIMENTS

Embodiment 1

Hereinafter, referring to FIGS. 1-8, the first preferred embodiment of the present invention is described. First, referring to FIG. 1, the general structure of the image forming apparatus in this embodiment, and the general structure of the cartridges in this embodiment are described.

<Image Forming Apparatus>

Figure 1:
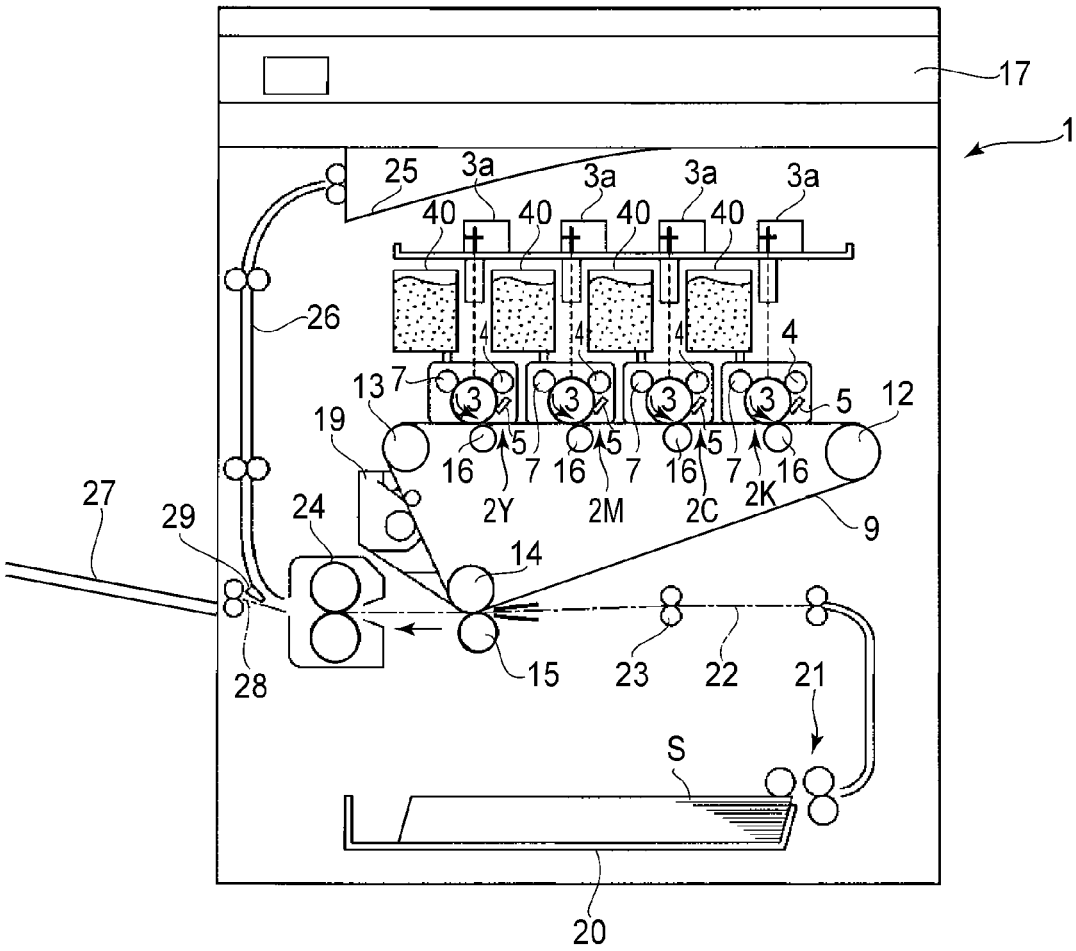
FIG. 1 is a schematic sectional view of the image forming apparatus in the first preferred embodiment of the present invention. It shows the general structure of the apparatus.

This embodiment is an example of the embodiment of the present invention in the form of a color image forming apparatus of the so-called tandem type. The main assembly 1 of the image forming apparatus has four cartridges, more specifically, yellow (Y), magenta (M), cyan (c), and black (K) cartridges 2Y, 2M, 2C, and 2K, respectively, which are in the top portion of the main assembly 1, as shown in FIG. 1.

The cartridge 2 has a photosensitive drum 3 as an image bearing member. It has also: a charge roller 4 as a charging means; a developing device 7; a cleaning device 5; etc., which are in the adjacencies of the peripheral surface of the photosensitive drum 3. The photosensitive drum 3 is cylindrical. It is uniformly charged by the charge roller 4. Then, the charged peripheral surface of the photosensitive drum 3 is exposed to (scanned by) a beam of laser light (broken line in FIG. 1) projected from an exposing device 3*a*. As a result, an electrostatic latent image is formed on the peripheral surface of the photosensitive drum 3. The developing device 7 develops the electrostatic latent image on the peripheral surface of the photosensitive drum 3, into a visible image, that is, an image formed of toner (which hereafter is referred to simply as "toner image"). More specifically, the developing device 7 supplies the peripheral surface of the photosensitive drum 3, on which the electrostatic latent image is present, with the toner supplied from the actual storage portion 31 (FIG. 2, for example) of the intermediary developer storage device 30. In order to prevent the amount of the toner in the developer storage portion 31 of each of the four intermediary developer storage devices 30 which are different in the color of the toner therein, from falling below a preset value, each intermediary developer storage device 30 is replenished with the toner from a corresponding toner bottle 40, by an amount proportional to the amount of toner consumption.

The cleaning device 5 removes the toner remaining on the peripheral surface of the photosensitive drum 3 after the transfer (first transfer) of the toner image on the photosensitive drum 3 onto an intermediary transfer belt 9. The cartridge 2, and the main assembly 1 of the image forming apparatus, are structured so that the cartridge 2 can be mounted (inserted) into a specific portion of the apparatus main assembly 1, or extracted from the main assembly 1. Since the cartridge 2 and the main assembly 1 are structured so that the former is removably mountable in the latter as described above, it is easy to maintain the image forming apparatus, and also, to replace the consumables of the apparatus. Therefore, it is easy to keep the apparatus at a desired level in terms of performance. That is, with the increase in the cumulative amount of usage of an image forming apparatus, the apparatus reduces in print quality because of the wear of various components of the cartridge 2, in particular, in the main assembly 1. However, the performance of the image forming apparatus can be kept at a desired level, as long as a service person or user maintains the apparatus, for example, by replacing the cartridge 2.

The image forming apparatus has the intermediary transfer belt 9, which is suspended so that it is circularly movable. Further, the intermediary transfer belt 9 is stretched so that it is under each cartridge 2 (FIG. 1). More specifically, the intermediary transfer belt 9 is an endless belt, and is suspended and kept stretched by a belt driving roller 12, a belt tensioning roller 13, and a second transfer roller 14 (inward transfer roller). The belt driving roller 12 circularly moves the intermediary transfer belt 9 by being driven by an unshown motor. The belt tensioning roller 13 is kept under the pressure applied by an unshown pressure applying means, whereby it provides the intermediary transfer belt 9 with a preset amount of tension. That is, the belt tensioning roller 13 prevents, by adjusting the intermediary transfer belt 9 in tension, the problem that the intermediary transfer belt 9 sags because of the change in the amount of load to which the intermediary transfer belt 9 is subjected. The inside second transfer roller 14 is positioned in a manner to oppose an outside second transfer roller 15 with the presence of the intermediary transfer belt 9 between the two second transfer rollers 14 and 15. It transfers the toner image onto a sheet of recording medium after the toner image is transferred onto the intermediary transfer belt 9. The main assembly 1 of the image forming apparatus has also a multiple (four) first transfer rollers 16, which are positioned so that they oppose the multiple (four) photosensitive drums 3, one for one, with the presence of the intermediary transfer belt 9 between the first transfer rollers 16 and photosensitive drums 3, one for one, forming thereby multiple (four) transfer areas in which the toner images are transferred onto the intermediary transfer belt 9 after the formation of the toner images on the photosensitive drums 3, one for one.

In an image forming operation for printing a copy of an original, the image formation data of the original are obtained by reading the original with the use of an original reading device 17. First, the photosensitive drum 3 is uniformly charged across its peripheral surface. Then, the uniformly charged area of the peripheral surface of the photosensitive drum 3 is exposed to (scanned by) the aforementioned beam of laser light. As a result, an electrostatic latent image of the original is effected on the peripheral surface of the photosensitive drum 3. Then, the area of the peripheral surface of the photosensitive drum 3, which has the electrostatic latent image, is supplied with toner by the developing device 7. Thus, the electrostatic latent image on the peripheral surface of the photosensitive drum 3 is developed into a visible image, that is, an image formed of toner (which hereafter may be referred to simply as toner image). This toner image is transferred (first transfer) onto the intermediary transfer belt 9 by the first transfer roller 16. In order to transfer the toner image from the photosensitive drum 3 onto the intermediary transfer belt 9, a preset amount of transfer voltage is applied to the first transfer area. After the transfer of the toner image onto the intermediary transfer belt 9, the toner image is transferred (second transfer) onto the sheet P of recording medium, in the second transfer area, which is made up of the inward and outward transfer rollers 14 and 15. The sheet P of recording medium is conveyed to the second transfer area by a recording medium conveying means, which will be described shortly. The toner remaining on the intermediary transfer belt 9 after the transfer (second transfer) of the toner image onto the sheet P of recording medium, that is, the toner which failed to be transferred from the intermediary transfer belt 9 onto the sheet P of recording medium, is recovered by a transfer belt cleaner 19.

The aforementioned recording medium conveying means conveys the sheet S of recording medium from a sheet feeder cassette 20 to the second transfer area. More specifically, the sheet P of recording medium is picked up from the sheet feeder cassette 20. Then, it is conveyed downstream, in terms of the normal recording medium conveyance direction, from a sheet feeding portion 21 to a pair of registration rollers 23, through a recording medium conveyance passage 22. Then, the sheet P is released downstream by the pair of registration rollers 23, while being corrected in attitude, in synchronism with the writing of the electrostatic latent image in the image forming stations. That is, the sheet P is released by the pair of registration roller 23 so that it reaches the second transfer area with a preset timing. After the transfer of the toner image onto the sheet P in the second transfer area, the toner image is fixed to the sheet P by a fixing device 24. After being conveyed through the fixing device 24, the sheet P is conveyed into a sheet discharge passage 26, that is, the passage for discharging the sheet P into a delivery tray 25 (face-up tray), or a sheet discharge passage 28, that is, the passage for discharging the sheet P into a delivery tray 27 (face-down tray). There is a sheet passage switching means 29, which is at the point where the sheet conveyance passage branches into the sheet discharge passages 26 and 28, so that the sheet P can be discharged either through the discharge passage 26 or 28 after the formation (printing) of the image of the original on the sheet S of recording medium.

Next, the intermediary developer storage device 30 is described. In this embodiment, the image forming apparatus uses multiple toners which are different in color. The multiple toners, different in color, are stored in their own toner bottles 40, one for one, which are cylindrical and are removably mountable in the main assembly 1 of the apparatus. The apparatus main assembly 1 and each toner bottle 40 are structured so that as a given toner bottle 40 is depleted of the toner therein by toner consumption (image forming operation), the bottle can be replaced by a user to provide the developing device 4 with a fresh supply of toner to continue the on-going image forming operation. The developer stored in the developing device 7 in this embodiment is two-component developer, that is, developer made up of nonmagnetic toner and magnetic carrier.

Figure 2:
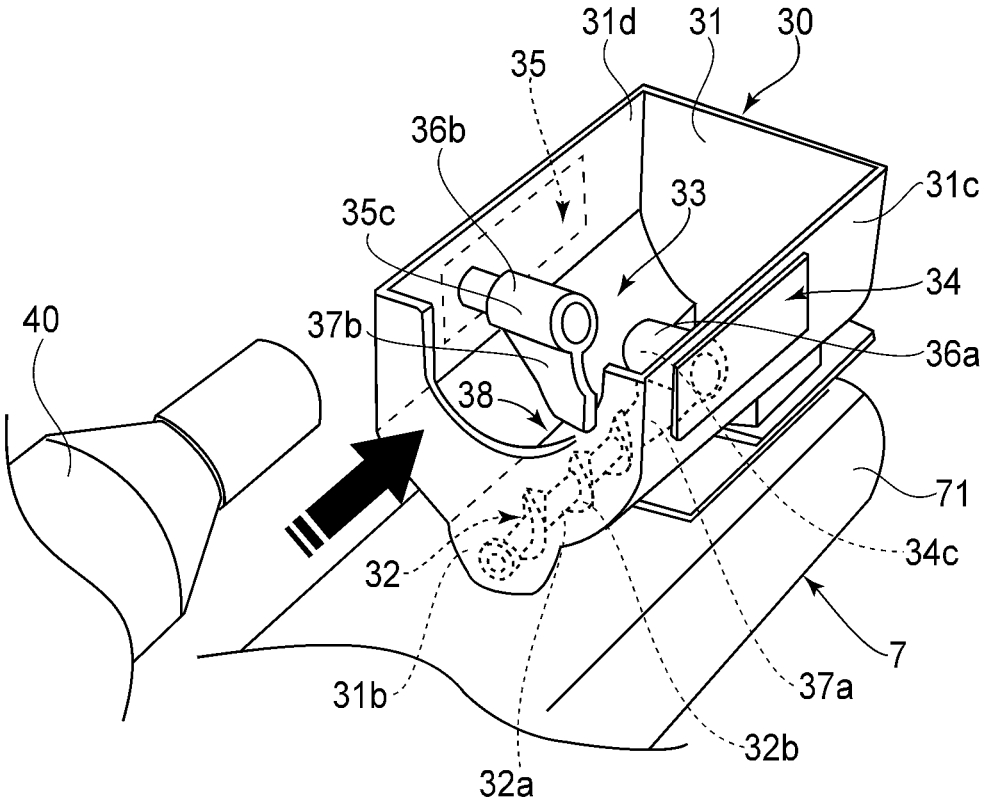
FIG. 2 is a perspective view of the intermediary developer storage device, and its adjacencies. It shows their structure.

Referring to FIG. 2, the intermediary developer storage device 30 has: an actual developer storage portion 31 in which the developer is stored; a screw 32, as a developer conveying means, for conveying the developer in the developer storage portion 31; and a sensor 33 as a developer detecting means, which detects the presence (absence) of developer in the developer storage portion 31.

Figure 3:
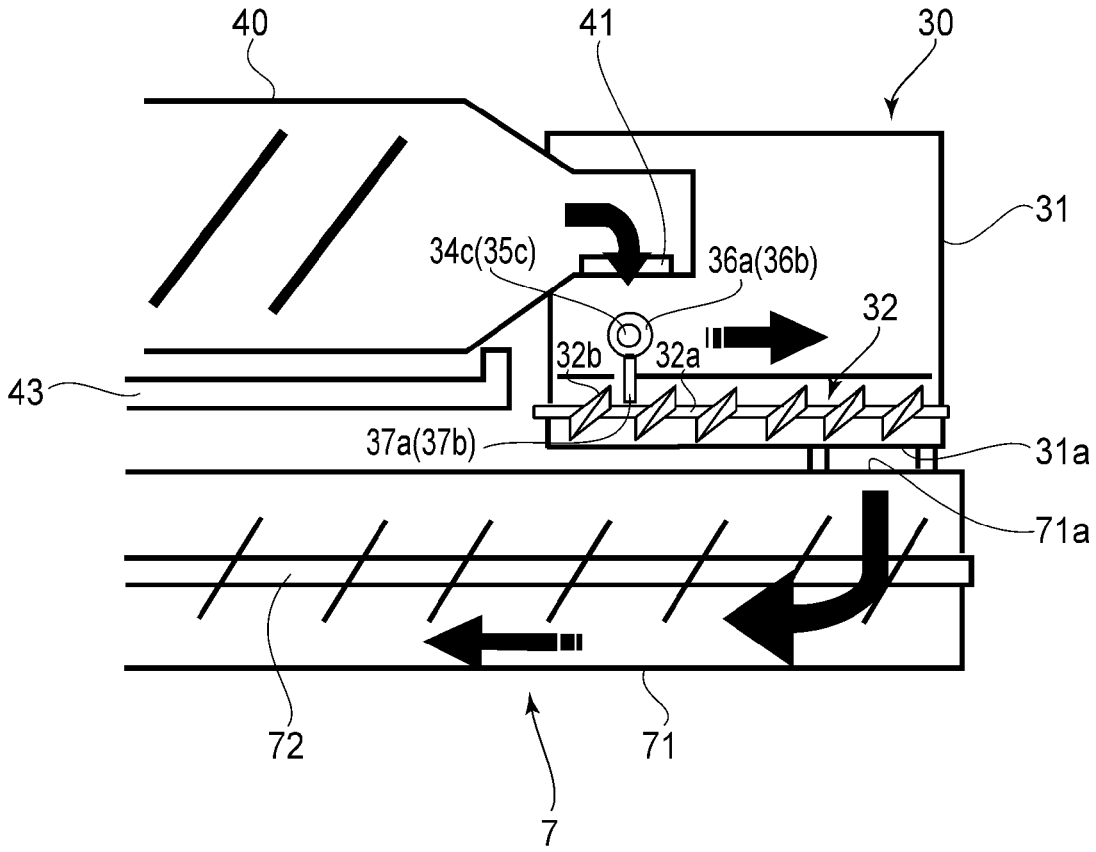
FIG. 3 is a schematic sectional view of the intermediary developer storage device, and its adjacencies. It shows their structure.
Figure 4:
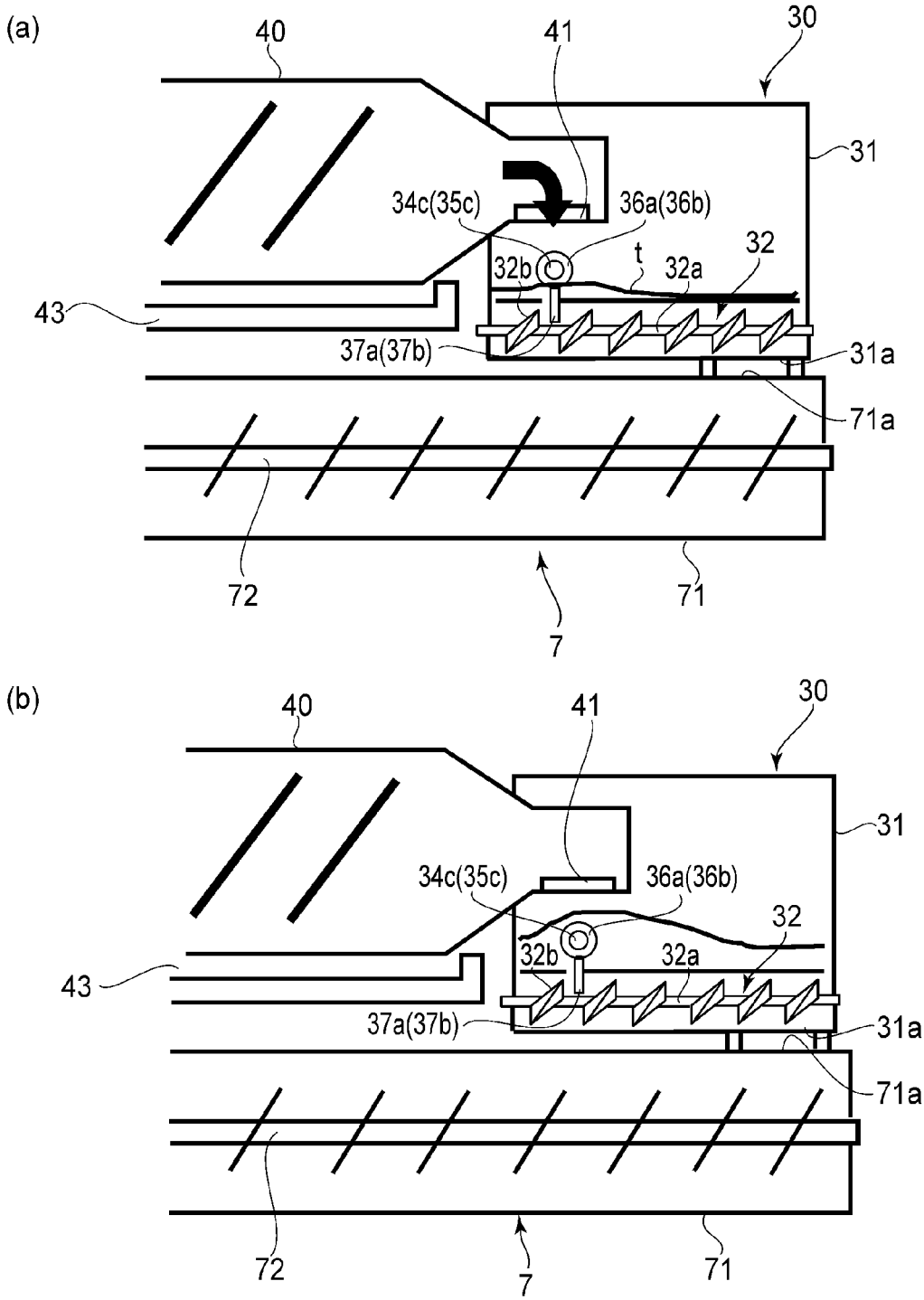
FIG. 4 is a drawing for describing the operation for supplying the intermediary developer storage device with the toner from a toner bottle.

The developer storage portion 31 functions as a buffer, that is, a chamber in which the toner delivered from the toner bottle 40 is temporarily stored. Thus, the developer storage portion 31 is positioned in the top portion of the developing device 7. Referring to FIGS. 3 and 4, the wall of the developer storage portion 31 has an opening 31*a* which is in connection to the development chamber 71 of the developing device 7. This opening is at the downstream end of the developer storage portion 31 in terms of the direction in which the developer in the developer storage portion 31 is conveyed by the screw 32 in the storage portion 31. The development chamber 71 has an opening 71*a*, which is in connection to the opening 31*a* of the developer storage portion 31. The opening 71*a* is at the upstream end of the development chamber 71 in terms of the direction in which the developer in the development chamber 71 is conveyed by a screw 72 as a developer conveying means, in the development chamber 71. The developer storage portion 31 is removably attachable to the development chamber 71 of the developing device 7. Further, the openings 31*a* and 71*a* are provided with an unshown shutter, which is opened or closed by the attachment of the developer storage portion 31 to the development chamber 71, or removal of the developer storage portion 31 from the development chamber 71.

When it is necessary to attach the toner bottle 40 to the developing device 7, the toner bottle 40 is to be horizontally inserted into the top portion of the developer storage portion 31. The developer in the toner bottle 40 is delivered into the developer storage portion 31 through the opening 41. As the toner bottle 40 is properly attached to the developer storage portion 31, the opening 41 of the toner bottle 40 is positioned at the upstream end of the screw 32 in terms of the direction in which the developer is conveyed by the screw 32 in the developer storage portion 31. The toner bottle 40 is removably attachable to the developer storage portion 31, and as the toner bottle 40 is properly positioned in the toner bottle holder 43, its opening 41 is positioned at a preset point in the developer storage portion 31.

The screw 32 in the developer storage portion 31 comprises a shaft 32*a*, and a spiral blade 32*b* fitted around the shaft 32*a*. It is in the bottom portion of the developer storage portion 31. More concretely, the developer storage portion 31 is provided with a developer conveyance trough (passage) 31*b*, which is semicircular in cross section. The developer conveyance trough 31*b* is parallel to the main portion of the developer storage portion 31, and protrudes downward from the bottom of the main portion of the developer storage portion 31. It is in the developer conveyance trough 31*b* that the screw 32 is located. The developer in the developer storage portion 31 is made to collect in the developer conveyance trough 31*b* by gravity, and is conveyed by the screw 32 to the opening 31*a* along the developer conveyance trough 31*b*.

Figure 6:
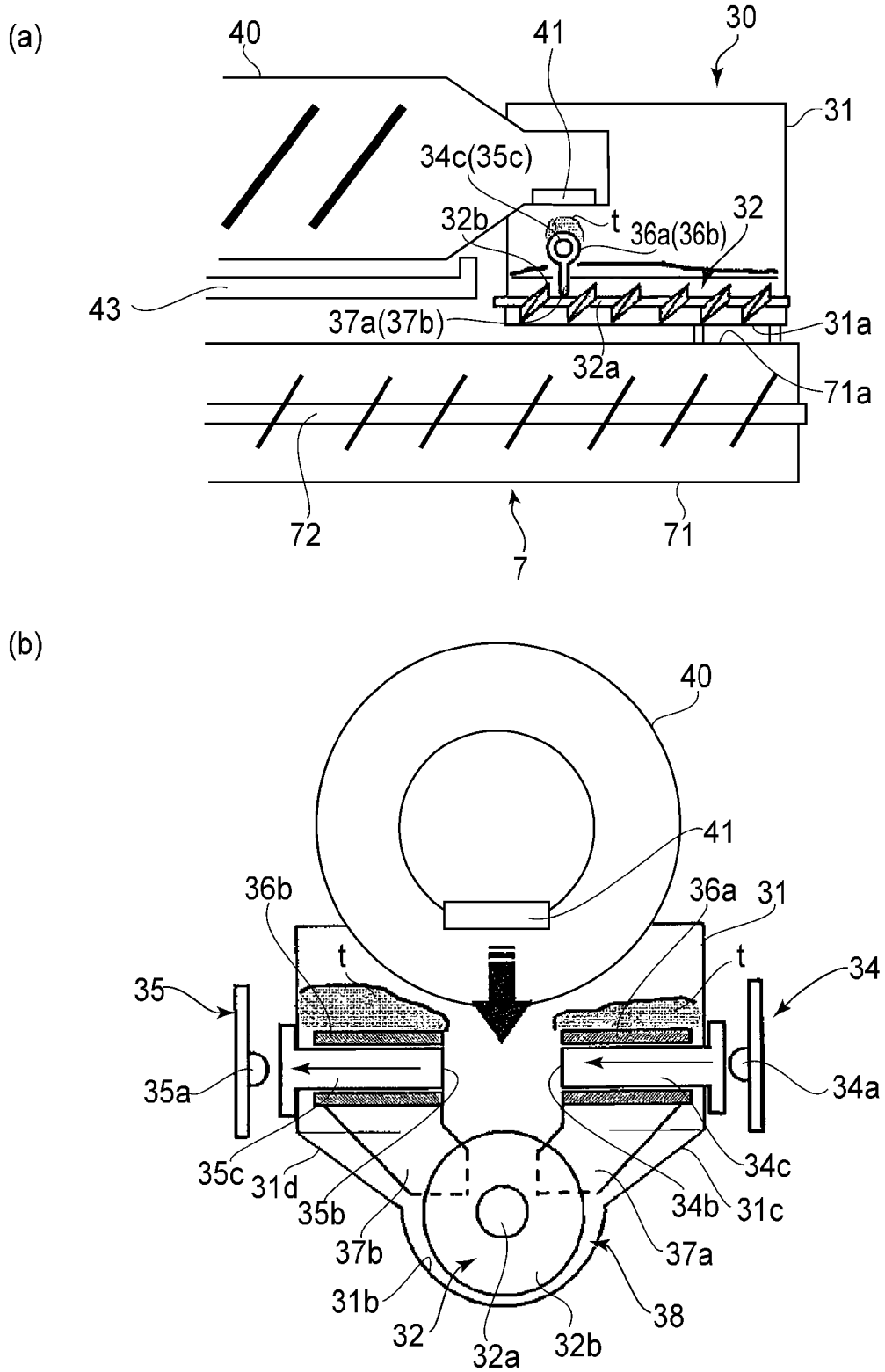
FIG. 6 shows the intermediary developer storage device and its adjacencies, immediately after the developer was delivered from a toner bottle.
Figure 7:
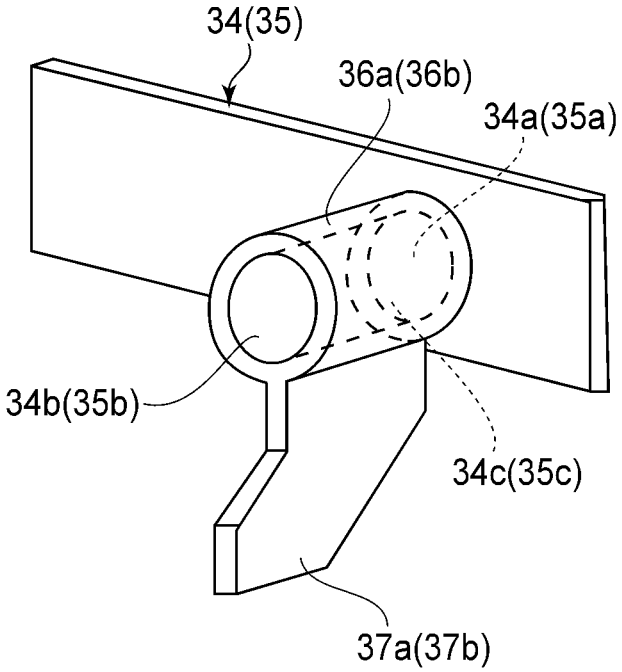
FIG. 7 is a perspective view of the light guide cover and its adjacencies in the first embodiment. It shows their structure.

Referring to FIGS. 2 and 6(*b*), the aforementioned sensor 33 is made up of a light emitting portion 34 and a light sensing portion 35. The light emitting portion 34 has: a light emitting element 34*a* which emits light; a light exit surface 34*b* through which the light emitted from the light emitting element 34*a* is projected toward the light sensing portion 35; and a light guide 34*c*, as the first light guiding member, which guides the light emitted by the light emitting element 34*a*, to the light exit surface 34*b*. The light emitting element 34*a* is an LED (light emitting diode), for example. As for the light sensing portion 35, it has: a light entrance surface 35*b*; a light sensing element 35*a*, such as a photo-diode for sensing (detecting) the light which came through the light entrance surface 35*b*; and a light guide 35*c*, as the second light guiding member, which guides light from the light entrance surface 35*b* to the light sensing element 35*a*. Thus, as long as the light emitted by the light emitting element 34*a* is blocked by the body of developer (toner) in the developer storage portion 31, that is, as long as the light emitted by the light emitting element 34*a* is not sensed by the light sensing element 35*a*, the control of the image forming apparatus determines that a sufficient amount of developer is present in the developer storage portion 31.

In terms of the horizontal direction, the sensor 33 structured as described above is below the opening 41 of the toner bottle 40. In terms of the developer conveyance direction, it is on the upstream side of the upstream end of the screw 32. The light emitting portion 34 and light sensing portion 35 are positioned so that the light exit surface 34*b* and the light entrance surface 35*b* of the light sensing portion 35 horizontally oppose each other with the presence of a preset distance between the two surfaces 34*b* and 35*b*. In this embodiment, the direction in which the two portions 34 and 35 oppose each other is roughly horizontal. Further, the light exit surface 34*b* and light entrance surface 35*b* are parallel to each other, and are roughly parallel to the gravity direction.

The light guide 34*c*, or the light guide on the light emitting side, and the light guide 35*c*, or the light guide on light sensing side, are cylindrical, and are molded of transparent resin such as PS (polystyrene), PC (poly-carbonate). Both the light emitting element 34*a* and light sensing element 35*a* are solidly attached to the side walls 31*c* and 31*d* of the developer storage portion 31, which oppose to each other (parallel to each other). Further, there is a substantial distance between the two walls 31*c* and 31*d*. Therefore, without the light guides 34*c* and 35*c*, it is difficult for the sensor 33 to accurately detect the presence (absence) of the developer. In this embodiment, therefore, the light emitting portion 34 and light sensing portion 35 are provided with the light guides 34*c* and 35*c*, respectively, to reduce the distance between the light exit surface 34*b* and light entrance surface 35*b*, that is, the distance which the light emitted by the light emitting element 34*a* has to travel through the developer storage portion 31 to be detected by the light sensing portion 35. Further, the light guides 34*c* and 35*c* are the same in shape, and are roughly horizontally aligned so that their axial lines roughly coincide with each other.

Also in this embodiment, both the light guides 34*c* and 35*c* have covers 36*a* and 36*b*, which cover virtually the entirety of the peripheral surface of the guides 34*c* and 35*c*, respectively. Referring to FIGS. 2, 6(*b*), and 7, the covers 36*a* and 36*b* are cylindrical, and their internal diameter is slightly larger than the external diameter of the light guides 34*c* and 35*c*, which also are cylindrical. Thus, the covers 36*a* and 36*b* loosely fit around the light guides 34*c* and 35*c*, being therefore rotatable relative to the light guides 34*c* and 35*c*, respectively.

As for the positional relationship between the covers 36*a* and 36*b*, and the light guides 34*c* and 35*c*, respectively, in terms of the direction of their axial lines, the covers 36*a* and 36*b* are positioned so that at least the adjacencies of the light exit surface 34*b* or light entrance surface 35*b* are covered. In other words, it is permissible that the covers 36*a* extend beyond the end (light exit surface 34*b*) of the light guides 34*c*, and/or the covers 36*b* extend beyond the end (light entrance surface 35*b*) of the light guide 35*c*. However, it is desired that every effort should be made to prevent the end of the light guide 34*c* from protruding beyond the corresponding end of the cover 36*a*, and also, the end of the light guide 35*c* from protruding beyond the corresponding end of the cover 36*b*. That is, it is desired that the periphery of the light exit surface 34*b* of the light guide 34*c*, and the periphery of the light entrance surface of the light guide 35*c*, are as little exposed as possible. However, even if the periphery of the light exit surface 34*b* of the light guide 34*c*, and the periphery of the light entrance surface of the light guide 35*c*, are slightly exposed, it is permissible that the cover 36 extends beyond the above described end surface of each light guide, provided that the amount of the exposure is within a range in which the bodies of toner having accumulated on the periphery of the light exit surface 34*b* of the light guide 34 and the periphery of the light entrance surface of the light guide 35 can be shaken down by the rotation of the covers 36*a* and 36*b*, respectively.

Further, the covers 36*a* and 36*b* are provided with screw engaging ribs 37*a* and 37*b*, which protrude from the peripheral surface of the cover 36*a*, and the peripheral surface of the cover 36*b* in the radius direction of the covers 36*a* and 36*b*, respectively. The screw engaging ribs 37*a* and 37*b* are flat and are parallel to the axial lines of the covers 36*a* and 36*b*, respectively. The edge of the screw engaging rib 37*a*, which faces the side wall 31*c*, and the edge of the screw engaging rib 37*b*, which faces the side wall 31*d*, are contoured the same as the cross sections of the side walls 31*c* and 31*d*. Thus, even if the covers 36*a* and 36*b* rotate relative to the light guides 34*c* and 35*c*, they do not collide with the side walls 31*c* and 31*d*, respectively.

Further, the screw engaging rib 37*a* is shaped so that the opposite end portion of the screw engaging rib 37*a* from the cylindrical portion of the cover 36*a*, slight extends in the opposite direction from the side wall 31*c* and, and the screw engaging rib 37*b* is shaped so that the opposite portion of the screw engaging ribs 37*a* from the cylindrical portion of the cover 36*b*, slightly extends in the opposite direction from the side wall 31*d*. Therefore, the end portion of the screw engaging rib 37*a*, that is, the opposite portion of the screw engaging rib 37*a* from the cylindrical portion of the cover 36*a* engages with the blade 32*b* of the screw 32, and so does the end portion of the screw engaging rib 37*b*, that is, the opposite portion of the screw engaging rib 37*b* from the cylindrical portion of the cover 36*b* engages with the blade 32*b* of the screw 32. In this embodiment, however, the screw 32 is at roughly the middle point between the light emitting portion 34 and light sensing portion 35, in terms of the direction perpendicular to the axial line of the screw 32. Therefore, the protruding portion of the screw engaging rib 37*a* and the protruding portion of the screw engaging rib 37*b* engage with the blade 32*b* of the screw 32 (fit between adjacent two spirals of blade 32*b*). The shape and positioning of the screw engaging ribs 37*a* and 37*b* should be determined based on the positional relationship between the light guides 34*c* and 35*c*, and the screw 32, so that the screw engaging rib 37*a* and 37*b* desirably engage with the blade 32*b* of the screw 32.

In this embodiment, the screw 32 and screw engaging ribs 37*a* and 37*b* are parts of a driving means 38 for rotationally moving the covers 36*a* and 36*b*. More specifically, the driving means 38 comprises the screw and screw engaging ribs 37*a* and 37*b* of the covers 36*a* and 36*b*, and an unshown motor. As the unshown motor is driven, the screw 32 rotates. Thus, the point of engagement between the screw 32 and screw engaging ribs 37*a*, and the point of engagement between the screw 32 and screw engaging rib 37*b*, shift in the direction parallel to the rotational axis of the screw 32. Thus, the screw engaging ribs 37*a* and 37*b* rotationally move the covers 36*a* and 36*b* to which the screw engaging ribs 37*a* and 37*b* are solidly attached.

Next, the intermediary developer storage device 30 structured as described above is described about its operation. As the toner in the developing device 7 is consumed by a printing operation started by the image forming apparatus, the development chamber 71 of the developing device 7 is provided with toner from the developer storage portion 31 of the intermediary developer storage device 30 through the openings 31*a* and 71*a*, by the amount equal to the amount by which toner was consumed by the developing device 7. As for the calculation of the amount by which the developing apparatus 7 is to be supplied with toner, the amount can be calculated based on the information obtained from the output of the magnetic sensor for detecting the ratio of mixture between the magnetic carrier and toner in the developing device 7 and the amount of toner consumption predictable from the information of the image to be printed, for example. It can also be calculated based on the information of the toner image on an image bearing member, such as the photosensitive drum 3 and intermediary transfer belt 9, which can be obtained with the uses of an image reading sensor. In any case, the amount by which toner is to be delivered into the development chamber 71 of the developing device 7 is calculated by the control unit of the image forming apparatus based on one of the above-mentioned information. Then, toner is incrementally delivered into the development chamber 71 by rotating the screw 32 in the developer storage portion 31 by the amount proportional to the amount by which the toner is to be delivered. After being delivered into the development chamber 71, the toner is conveyed by the screw 72 while being stirred, and then, is used for development.

On the other hand, the amount of the toner in the developer storage portion 31 is detected by the sensor 33. More concretely, referring to FIG. 4(*a*), when there is no toner between the light emitting portion 34 and light sensing portion 35, the light emitted by the light emitting element 34*a* is detected by the light sensing element 35*a*; it is detected that the amount of toner in the developer storage portion 31 is below a preset level. In such a case, the toner bottle 40 is rotated to deliver the toner in the bottle 40 into the developer storage portion 31. Next, referring to FIG. 4(*b*), when a body t of toner is between the light emitting portion 34 and light sensing portion 35, the light from the light emitting element 34*a* is blocked by the body t of toner, and therefore, cannot be detected by the light sensing element 35*a*. Thus, it is determined that there is a sufficient amount of toner in the developer storage portion 31. The route through which the toner in the toner bottle 40 is delivered to the development chamber 71 is as shown by arrow marks in FIG. 3.

Figure 5:
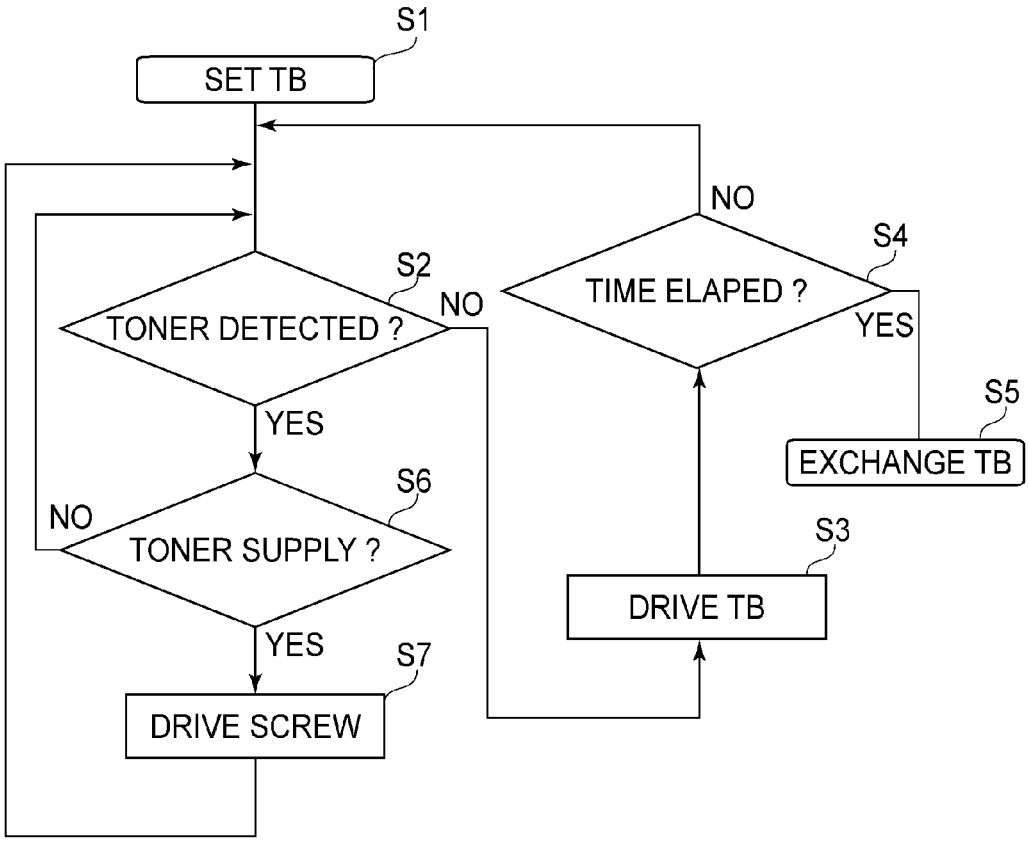
FIG. 5 is a flowchart of the operational sequence for supplying the intermediary developer storage device with the toner from a toner bottle.

Next, referring to FIG. 5, the sequence of the operation for delivering the toner in the toner bottle 40, to the developer storage portion 31 after the setting of the bottle 40 on the toner bottle holder 43 is described. First, the toner bottle 40 is to be set on the toner bottle holding portion 43 by a user. As the bottle 40 is set (S1), the sequence for detecting the amount of the toner remaining in the toner buffer (intermediary developer storage device) is started with a preset timing. In this sequence, the presence (absence) of the toner is detected by the sensor 33 (S2). If the control unit detects through the sensor 33 that there is no toner, it rotates the toner bottle 40 (S3). As long as the toner bottle contains toner, the toner in the toner bottle 40 is delivered into the developer storage portion 31 through the opening 41. This operational sequence is repeated until the body t of toner completely blocks the light from the light emitting portion 34, between the light emitting portion 34 and light sensing portion 35 Thus, the amount of toner in the developer storage portion 31 is kept stable at a preset value by repeating the above described toner delivery sequence. On the other hand, if the light sensing element 35*a* of the sensor 33 continues to sense the light even after the toner bottle 40 is rotated for a preset length of time, the control unit determines that the toner bottle 40 is empty. Then, it gives on the display of the image forming apparatus, an instruction that a user is to replace the toner bottle 40.

When the developing device 7 is in the state in which the sensor 33 detects toner, there is toner in the developer storage portion 31, and the amount of the toner is no less than a preset value. It is in this state that toner is delivered from the developer storage portion 31 into the development chamber 71 of the developing device 7 as necessary, as described before (S6, S7). That is, the amount by which the developing device 7 is to be supplied with toner while an image forming operation is continued is calculated by the control unit of the image forming apparatus, and then, a toner delivery command is issued by the control unit (S6). Then, in response to this command, the screw 32 in the developer storage portion 31 is driven, whereby the toner in the developer storage portion 31 is delivered into the development chamber 71 (S7). As described above, in this embodiment, the amount of toner in the developer storage portion 31 is kept at a preset value by delivering a fresh supply of toner from the toner bottle 70 to the developer storage portion 31, based on the output of the sensor 33. Further, it is in the state in which the developer storage portion 31 is stable in the amount of toner therein that the developing device 7 is incrementally supplied with toner by the amount which is calculated by the control unit of the image forming apparatus, that is, the amount by which the developing device 7 needs to be supplied with toner. Therefore, the developing device 7 is kept constant at a preset level in the ratio of mixture between the toner and magnetic carrier in the developing device 7. Therefore, the image forming apparatus in this embodiment is reliable in image forming operation.

On the other hand, in the case of an image forming apparatus, such as the one in this embodiment, the control unit of which controls the toner delivery operation according to the information obtained from the output of the optical sensor 33, it is possible for the toner in the developer storage portion 31 to accumulate on the light guides 34*c* and 35*c* of the sensor 33, and causes thereby sensor 33 to fail to accurately detect the presence (or absence) of toner in the developer storage portion 31. The accumulation of toner on the light guides 34*c* and 35*c* occurs because the certain amount of toner scatters into the body of air in the developer storage portion 31 when the toner is delivered from the toner bottle 40 into the developer storage portion 31. Therefore, it occurs to a certain degree regardless of the positioning of the sensor 33. In particular, in the case of this embodiment, the sensor 33 is below the opening of the toner bottle 40, and therefore, it is virtually impossible to prevent the toner from accumulating on the sensor 33.

The reason why the sensor 33 is positioned below the opening 41 is that in order to keep the developer storage portion 31 stable in the amount of the toner therein, the responsiveness of the sensor 33 to the change in the amount of the toner in the developer storage portion 31 was taken into consideration as one of the important factors which affects the performance of the developing device 7. In order to keep the sensor 33 excellent in responsiveness, it is desired that the sensor 33 is directly below the opening 41 of the toner bottle 40, directly above the toner conveyance screw 32, and near the screw 32. To begin with, some small image forming apparatuses have no place, but the above described place, for the sensor 33 to be positioned. Moreover, in order to deal with the increase in the capacity of the developer storage portion 31, and also, to efficiently use the light from the light emitting element 34*a* of the optical sensor 33, the light guides 34*c* and 35*c* have to be lengthened.

Referring to FIGS. 6(*a*) and 6(*b*), in the case of this embodiment in which the sensor 33 is positioned below the opening 41 of the toner bottle 40 as described above, the body t of toner discharged from the toner bottle 40 is likely to accumulate on the light guides 34*c* and 35*c*. Further, once the body t of toner accumulates on the light guides 34*c* and 35*c*, it cannot be moved by the rotation of the screw 32, unless the light guides 34*c* and 35*c* are provided with the covers 36*a* and 36*b*, respectively, as in this embodiment.

Further, if the bodies t of toner on the light guides 34*c* and 35*c* are left unattended while being left exposed to high temperature and humidity, the bodies t of toner are likely to absorb the humidity and reduce in fluidity (become stickier and turn semisolid). As long as the toner has simply accumulated on the light guides 34*c* and 35*c*, it does not affect the projection and reception of the light from the light emitting element 34*a*. In other words, simple accumulation of toner on the light guides 34*c* and 35*c* does not lead to any problem. However, if the bodies t of toner on the light guides 34*c* and 35*c* are left unattended for a substantial length of time, they reduce in fluidity and become semisolid. Then, the semisolid bodies t of toner grow like an icicle, and sometimes hang as far as the light exit surface 34*b* and light entrance surface 35*b* of the sensor 33. Eventually, they grow long enough to block the light from the light emitting element 34*a*, that is, long enough to make it possible for the sensor to fail to accurately detect the presence (or absence) of the bodies t of toner.

The possibility of occurrence of the above described situation is sometimes exacerbated by how the image forming apparatus is used, or the environment in which the apparatus is used. For example, if the image forming apparatus is left unattended for a long period of time, for example, during consecutive holidays, in an area like Asia which is high in temperature and humidity, the possibility is higher. Further, the possibility is also higher if the image forming apparatus is rarely used for printing, or the apparatus is used mainly for outputting black-and-white images, that is, the color developers are rarely used.

In this embodiment, therefore, the peripheral surface of the light guide 34*c* and that of the light guide 35*c* are covered with the rotationally movable light guide covers 36*a* and 36*b*, respectively, so that the bodies t of toner on the light guides 34*c* and 35*c* (covers 36*a* and 36*b*) can be shaken down by rotationally moving the covers 36*a* and 36*b*, respectively. More specifically, the covers 36*a* and 36*b* with which the light guides 34*c* and 35*c* are provided are cylindrical, and coaxial with the light guides 34*c* and 35*c*, and are rotationally movable around the light guides 34*c* and 35*c*, respectively. Further, the covers 36*a* and 36*b* have the screw engaging ribs 37*a* and 37*b*, which protrude from the peripheral surfaces of the covers 36*a* and 36*b*, respectively. The covers 36*a* and 36*b* are positioned so that the screw engaging ribs 37*a* and 37*b* fit between the adjacent two spirals of the blade 32*b* (guides) of the screw 32, and come into contact with the blade 32*b* as the screw 32 is rotated.

Figure 8:
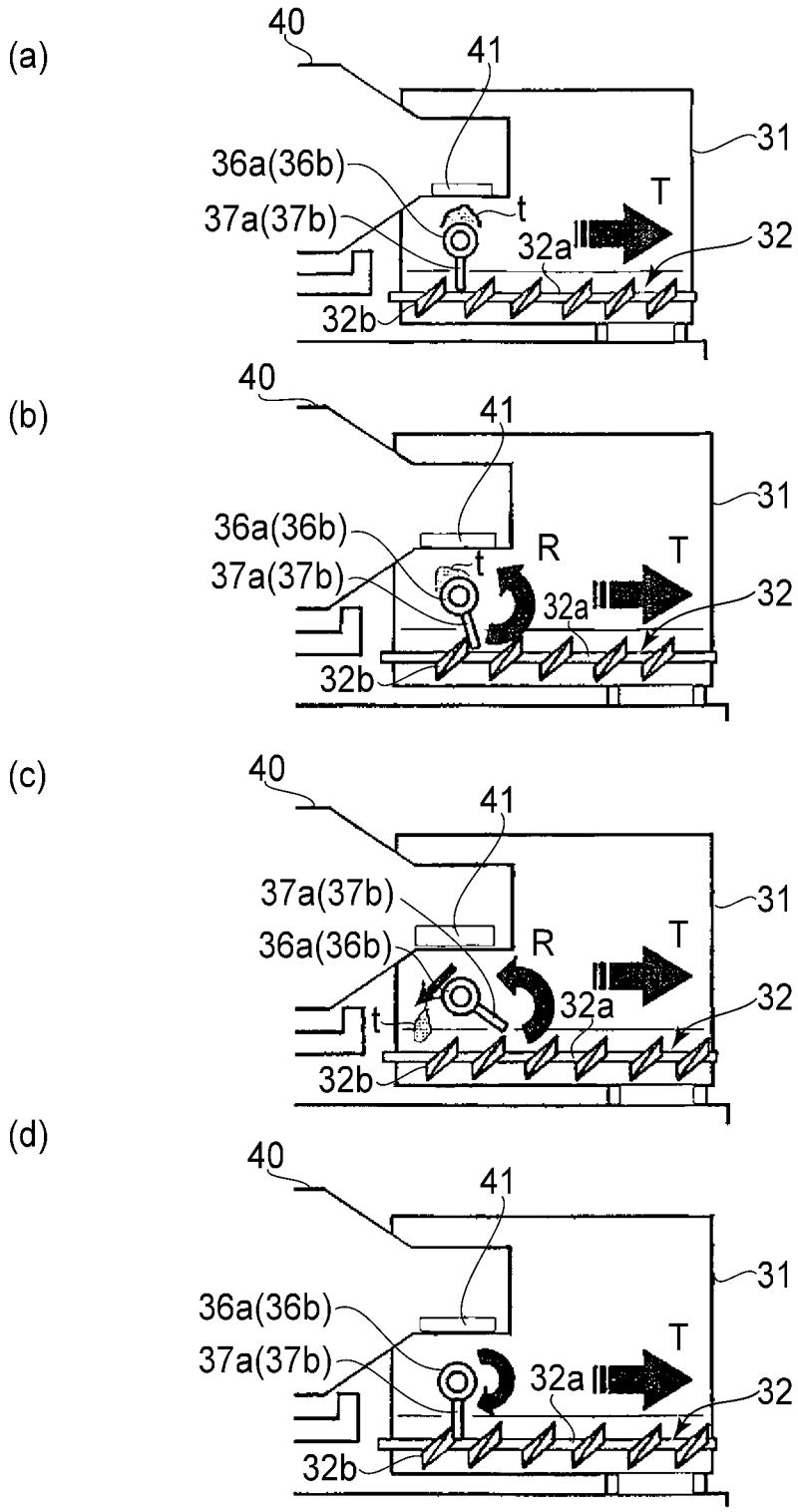
FIG. 8 is a drawing for describing the movement of the light guide cover in the first embodiment.

Next, referring to FIG. 8, the light guide covers 36*a* and 36*b* structured as described above are rotationally moved in an oscillatory manner. First, referring to FIG. 8(*a*), as the toner in the toner bottle 40 is delivered into the developer storage portion 31, a certain amount of the toner accumulates on the covers 36*a* and 36*b*. Thus, after the delivery of the toner, there is a certain amount of the toner on the covers 36*a* and 36*b*. Then, as the next toner delivery command for delivering a fresh supply of toner to the developing device 7 is issued by the control unit of the image forming apparatus, the screw 32 is driven to convey the toner from the developer storage portion 31 into the development chamber 71 of the developing device 7. As the screw 32 is driven, the spirals of the blade 32*b* (guides) of the screw 32 are rotated about the rotational axis of the screw 32, and come into contact (engage) with the screw engaging ribs 37*a* and 37*b* as shown in FIG. 8(*b*). Then, as the screw 32 is rotated further, the point of contact between the blade 32*b* and screw engaging rib 37*a* and that between the blade 32*b* and screw engaging rib 37*b* shift in the direction indicated by an arrow mark T in FIG. 8, causing thereby the covers 36*a* and 36*b* to rotationally move in the direction indicated by an arrow mark R. Thus, the bodies t of toner on the covers 36*a* and 36*b* fall from the covers 36*a* and 36*b* as shown in FIG. 8(*c*). Eventually, the screw engaging ribs 37*a* and 37*b* ride over the spiral of the blade 32*b*, with which they are in contact. Then, the point of contact between the screw engaging rib 37*a* and the blade 32*b* of the screw 32, and the point of contact between the screw engaging rib 37*b* and blade 32*b* of the screw 32, begin to shift in the opposite direction in which they have been shifting. Thus, the covers 36*a* and 36*b* are rotationally moved by the spiral of the blade 32*b*, in the opposite direction from the direction in which they have been rotationally moved, as shown in FIG. 8(*d*).

According to this embodiment, the light guides 34*c* and 35*c* are covered with the light guide covers 36*a* and 36*b*, respectively, at least across their peripheral surface. Therefore, it is on the covers 36*a* and 36*b* that the toner accumulates. The toner on the covers 36*a* and 36*b* can be shaken down by rotationally moving the covers 36*a* and 36*b*. In other words, this embodiment can make it unlikely for the sensor 33 to make a detection error attributable to the toner accumulation on the sensor 33. More specifically, in this embodiment, the above-described operational sequence is continuously repeated while the screw 32 is conveying toner. Therefore, even in a case where the image forming apparatus is left unattended for a long period of time in an ambience which is high in temperature and humidity, and/or is used under the condition which is detrimental to toner, it does not occur that toner remains accumulated on the light guides 34*c* and 35*c* (light guide covers 36*a* and 36*b*). Therefore, the problem that the sensor 33 makes a detection error attributable to the toner accumulation on the light guides 34*c* and 35*c* is unlikely to be induced.

Incidentally, when no command for supplying the developing device 7 with toner is issued (screw 32 is not driven), the light guide covers 36*a* and 36*b* are not rotationally moved in the oscillatory manner. To begin with, however, unless toner is conveyed to the developing device 7, the toner in the developer storage portion 31 does not reduce, and therefore, the toner in the toner bottle 40 is not delivered to the developer storage portion 31. Thus, virtually no toner lands on the light guides 34*c* and 35*c* (covers 36*a* and 36*b*). In this case, therefore, the removal of the toner is not a matter of concern.

Also in this embodiment, the light guide covers 36*a* and 36*a* are fitted around the light guides 34*c* and 35*c* in such a manner that they cover the peripheral surface of the light guide 34*c* and that of the light guide 35*c*, and also, that they are rotatable about the light guides 34*c* and 35*c*, respectively. Therefore, it does not occur that when the light guide covers 36*a* and 36*b* are rotationally moved to shake down the toner thereon, the light guides 34*c* and 35*c* are directly subjected to an excessive amount of load. Thus, the image forming apparatus in this embodiment is significantly smaller than any image forming apparatus in accordance to the prior art, in the mount of the external disturbance, such as the vibrations of the light guides 34*c* and 35*c*, and the changes in their position, which affect the accuracy with which the sensor 33 detects the presence (or absence) of toner.

Embodiment 2

Figure 9:
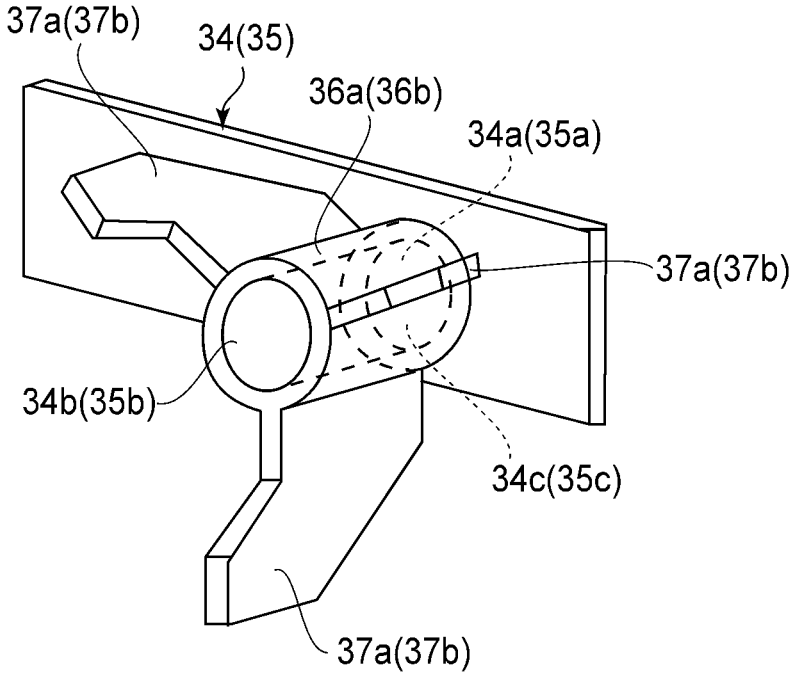
FIG. 9 is a perspective view of the light guide cover and its adjacencies in the second embodiment. It shows their structure.
Figure 10:
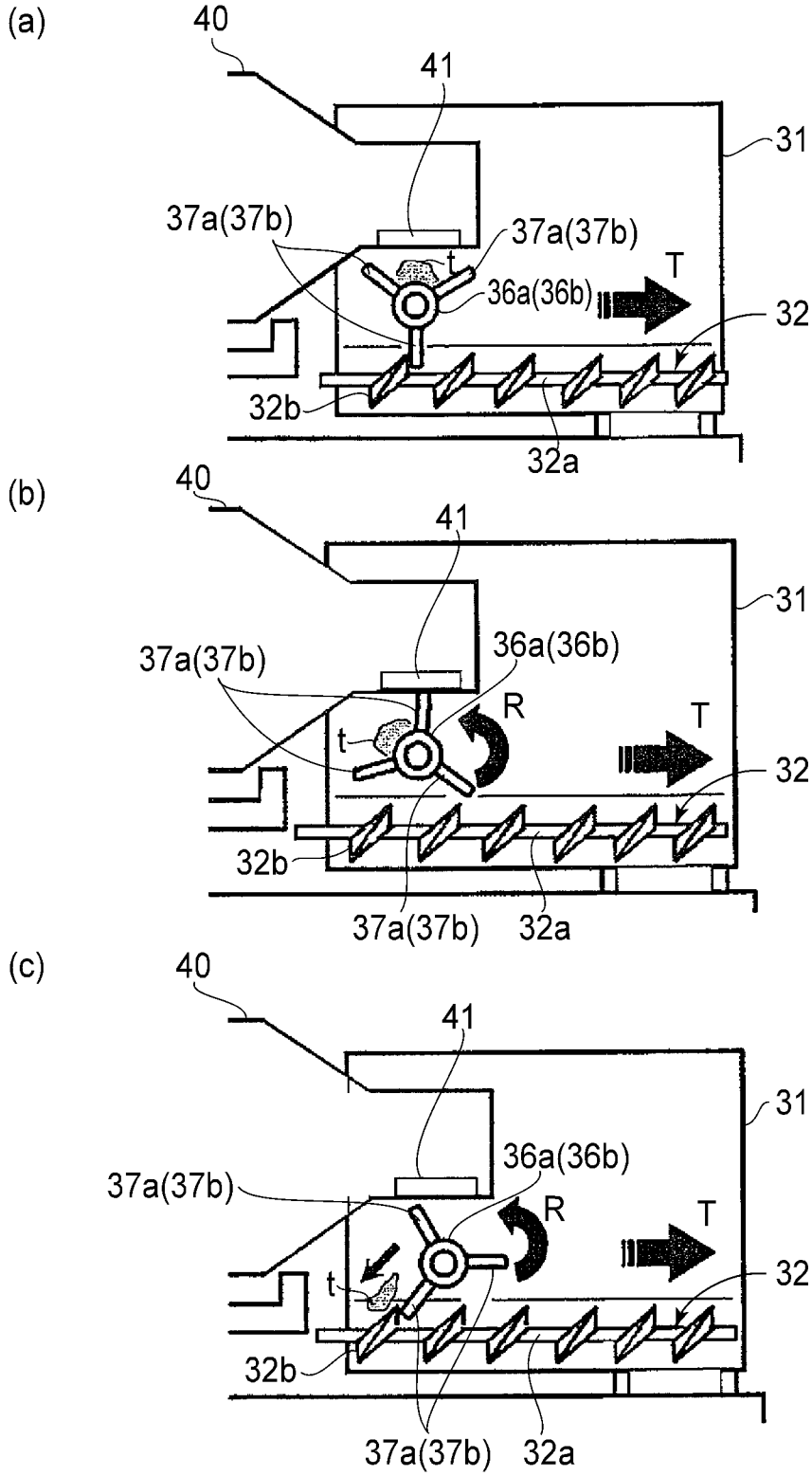
FIG. 10 is a drawing for describing the movement of the light guide cover in the second embodiment.

Next, referring to FIGS. 9 and 10, the second preferred embodiment of the present invention is described. This embodiment is different from the first embodiment in the number of the screw engaging ribs 37*a* (37*b*) of the covers 36*a* (36*b*) of the light guide 34*c* (35*c*). That is, in this embodiment, the light guide cover 36*a* (36*b*) is provided with multiple screw engaging ribs 37*a* (37*b*), which protrude from the peripheral surface of each cover 36*a* (36*b*). In terms of the direction of the rotational movement of the cover 36*a* (36*b*), the multiple screw engaging ribs 37*a* (37*b*) are evenly distributed so that as the screw 32 is rotated, these multiple screw engaging ribs 37*a* (37*b*) sequentially engage with the blade 32*b* of the screw 32. In this embodiment, the number of the ribs 37*a* (37*b*) is three, and therefore, their interval is 120°.

Also in this embodiment, as the screw 32 is driven, one of the spirals of the blade 32*b* of the screw 32 comes into contact with one (first) of the three screw engaging ribs 37*a* (37*b*) as shown in FIG. 8(*a*). Then, as the screw 32 is further rotated, the point of contact between the first screw engaging rib 37*a* and the spiral of the blade 32*b* shifts in the toner conveyance direction (indicated by arrow mark T). Thus, the cover 36*a* (36*b*) is rotationally moved in the direction indicated by an arrow mark R as shown in FIG. 8(*b*). Eventually, the first screw engaging rib 37*a* (37*b*) which is in engagement with the spiral of the blade 32*b* rides over the peak of the spiral. As the rib 37*a* (37*b*) which is in engagement with the spiral of the blade 32*b* rides over the peak of the spiral, the next screw engaging rib 37*a* (37*b*), that is, the immediately upstream rib 37*a* (37*b*) moves into the front side of the next spiral of the blade 32*b*, that is, the immediately upstream spiral of the blade 32*b* in terms of the toner conveyance direction. Then, as the screw 32 is rotated further, the blade 32*b* comes into contact with this screw engaging rib 37*a* (37*b*). Then, as the screw 32 is rotated further, the point of contact with this spiral of the blade 32*b* and the screw engaging second rib 37*a* (37*b*) is made to shift in the toner conveyance direction indicated by the arrow mark T, causing thereby the cover 36*a* (36*b*) to rotationally move in the direction indicated by the arrow mark R. This sequence operational sequence is continuously repeated while the screw 32 is conveying toner. Therefore, the cover 36*a* (36*b*) is continuously rotated 360° in the same direction. Thus, the body t of toner on the cover 36*a* (36*b*) falls from the cover 36*a* (36*b*).

In this embodiment, the cover 36*a* (36*b*) is made to continuously rotate 360° in the same direction. Thus, this embodiment ensures better than the first embodiment that the toner on the cover 36*a* (36*b*) is shaken down, and therefore, is prevented from accumulating on the cover 36*a* (36*b*). Further, the rotation of the cover 36*a* (36*b*) is affected by the pitch of the spirals of the blade 32*b*. Therefore, from the point of ensuring that the cover 36*a* (36*b*) is rotated, it is desired that the cover 36*a* (36*b*) is provided with no less than five equally spaced screw engaging ribs 37*a* (37*b*) so that the interval between the adjacent two multiple ribs 37*a* (37*b*) is no more than 72°. The structural arrangement for providing the cover 36*a* (36*b*) with five or more screw engaging ribs 37*a* (37*b*), and the effects of such arrangement are, similar to those in the first embodiment.

Embodiment 3

Figure 11:
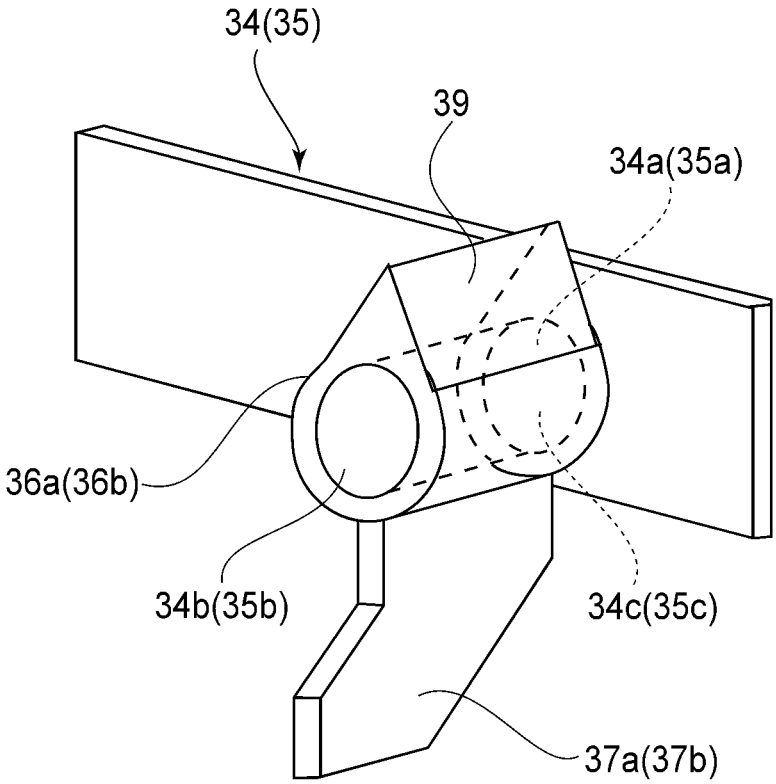
FIG. 11 is a perspective view of the light guide cover and its adjacencies in the third embodiment. It shows their structure.
Figure 12:
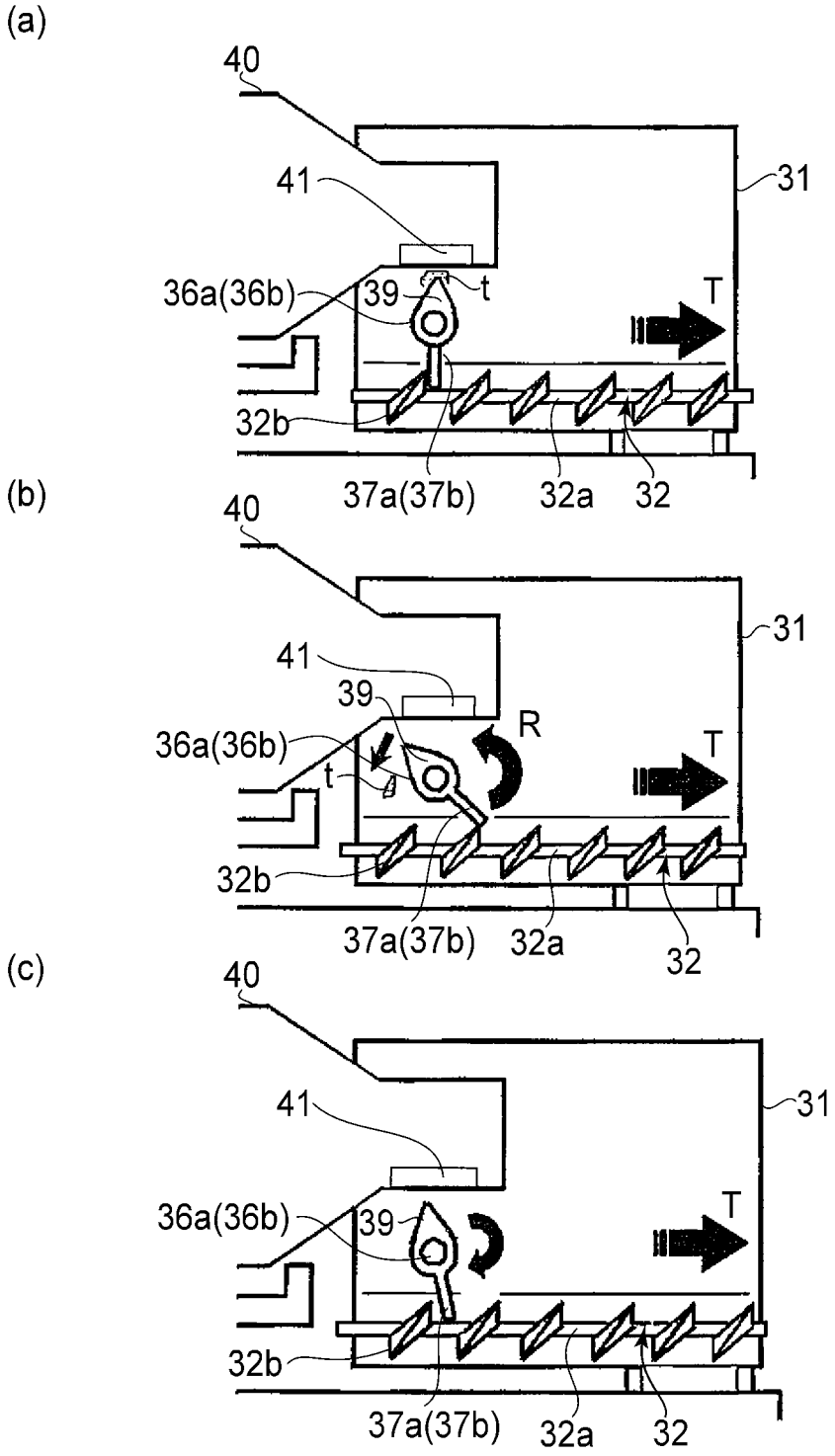
FIG. 12 is a drawing for describing the movement of the light guide cover in the third embodiment.
Figure 13:
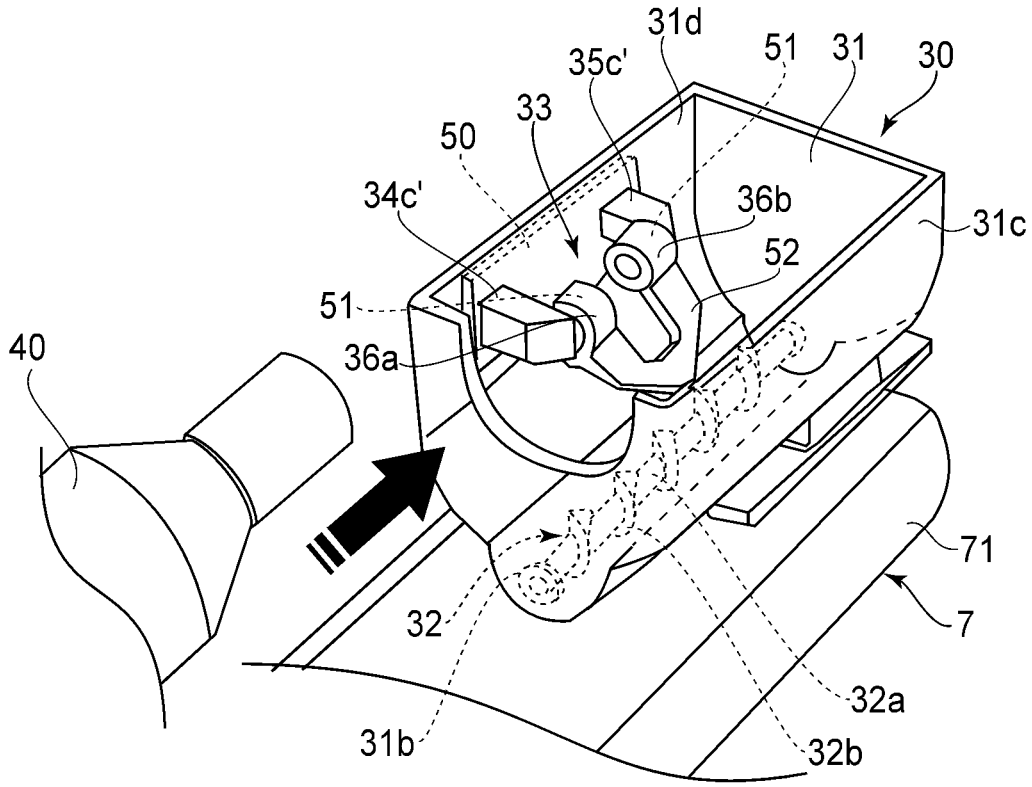
FIG. 13 is a perspective view of the light guide cover and its adjacencies in the fourth embodiment. It shows their structure.
Figure 14:
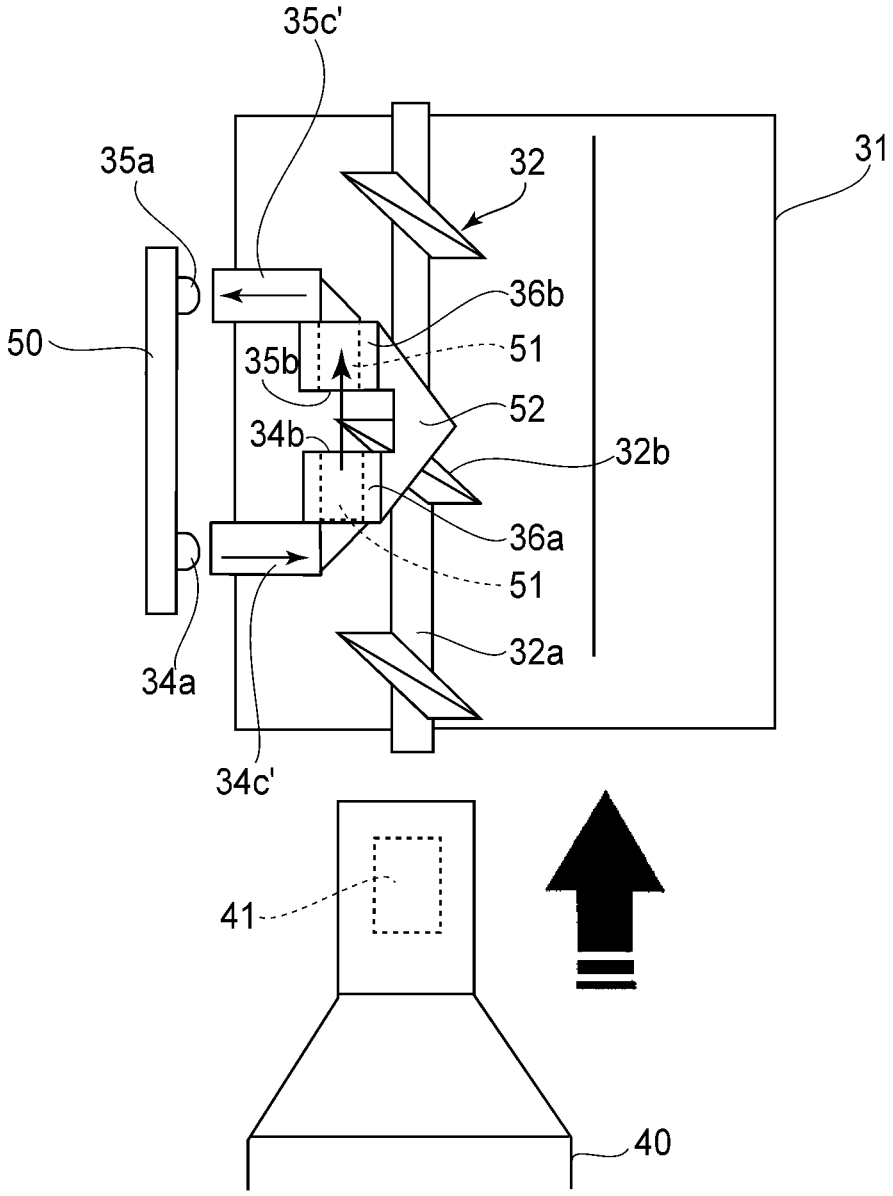
FIG. 14 is a top plan view of the light guide cover and its adjacencies, in the fourth embodiment.
Figure 15:
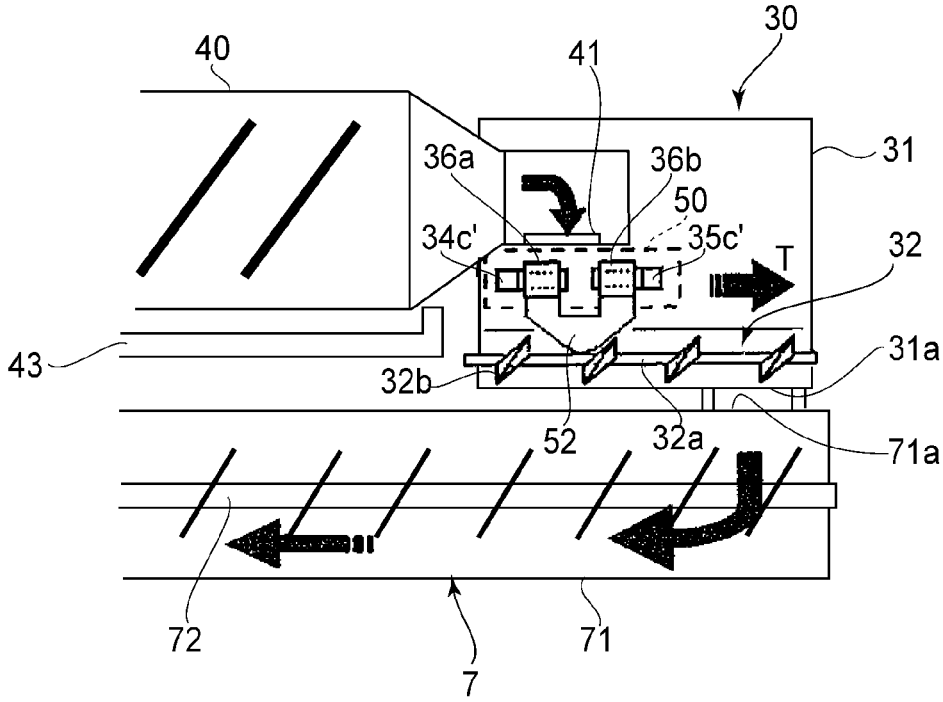
FIG. 15 shows the intermediary developer storage device and its adjacencies in the fourth embodiment, immediately after the developer was delivered from a toner bottle.
Figure 15:
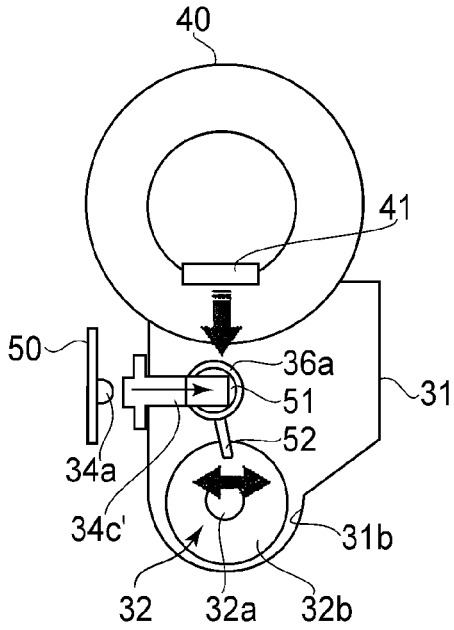
Figure 16:
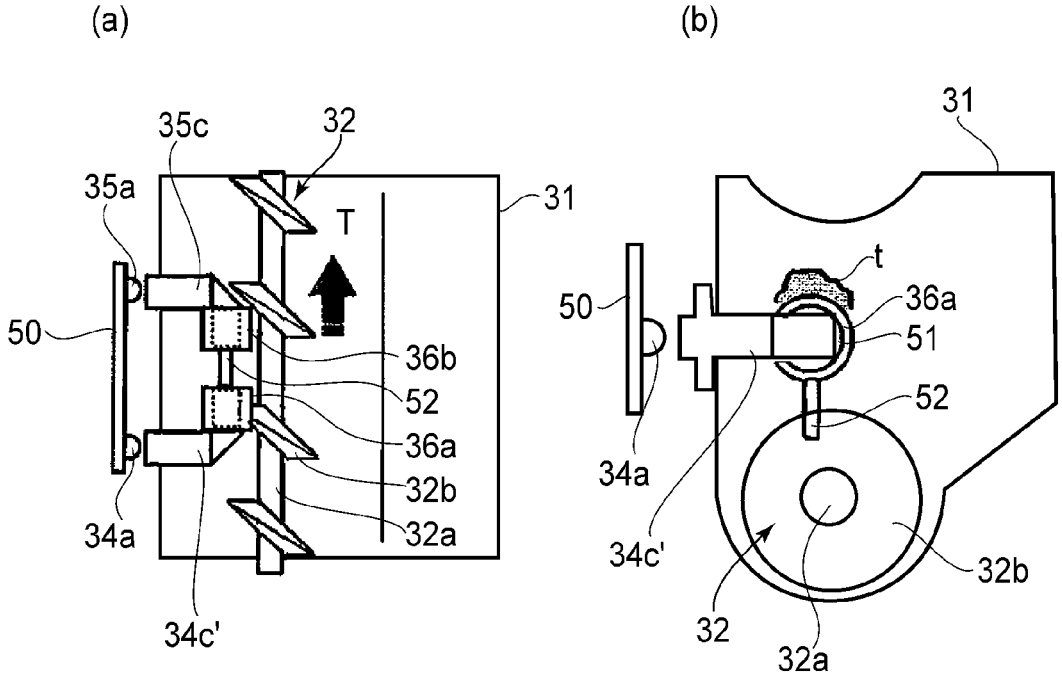
FIGS. 16(*a*) and 16(*b*) are drawing for describing the movement of the light guide cover in the fourth embodiment.
Figure 17:
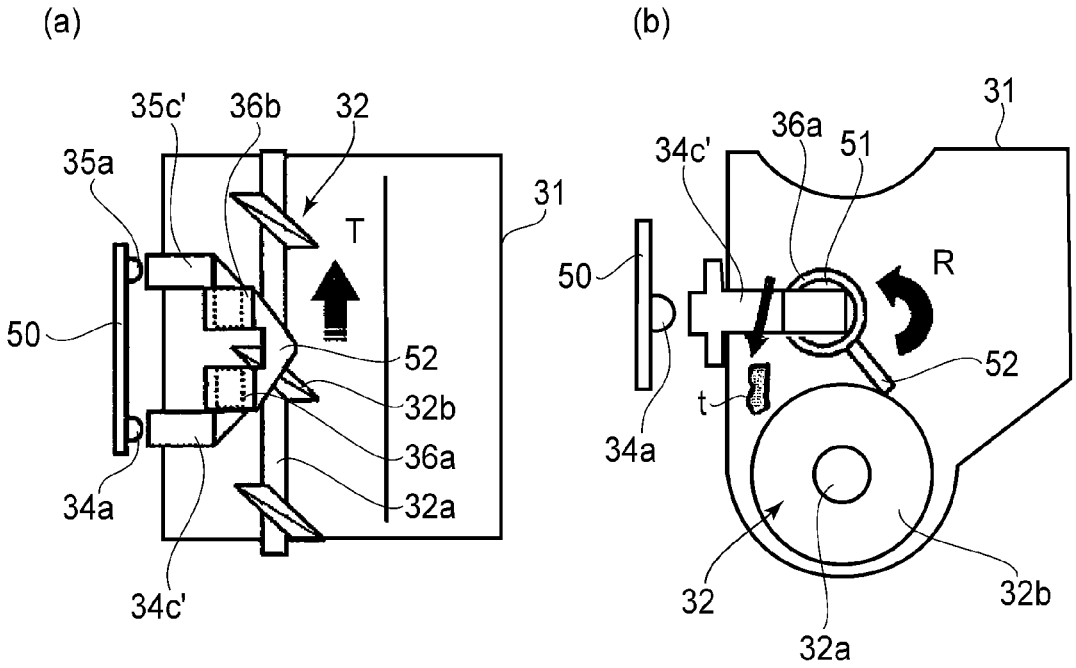
FIGS. 17(*a*) and 17(*b*) are drawings for describing the movement of the same light guide cover as the one in FIGS. 16(*a*) and 16(*b*), and show the state of the light guide cover after the light guide cover was rotationally moved from the position in which it is in FIGS. 16(*a*) and 16(*b*).

Next, referring to FIGS. 11 and 12, the third preferred embodiment of the present invention is described. In this embodiment, the light guide cover 36*a* (36*b*) is provided with a wedge-like portion 39, which protrudes from the peripheral surface of the main portion of the cover 36*a* (36*b*) in the opposite direction from the screw engaging rib 37*a* (37*b*) of the cover 36*a* (36*b*). The cross section of the tip of the wedge-like portion 39 is acute in angle. More specifically, the cover 36*a* (36*b*) has a screw engaging rib 37*a* (37*b*) and the wedge-like portion 39. The rib 37*a* (37*b*) protrudes from the portion of the cover 36*a* (36*b*), which faces downward in the developer storage portion 31, whereas the wedge-like portion 39 protrudes from the portion of the cover 36*a* (36*b*), which faces upward in the developer storage portion 31, being therefore opposite from the screw engaging rib 37*a* (37*b*) in the direction in which it protrudes. In other words, the rib 37*a* (37*b*) and wedge-like portion 39 are 180° apart in terms of rotational phase.

This structural arrangement makes it difficult for toner to accumulate on the upwardly facing area of the light guide cover 36*a* (36*b*). Thus, even if the screw 32 is not driven, the amount by which toner accumulates on the cover 36*a* (36*b*) in this embodiment is significantly smaller than that on the cover 36*a* (36*b*) in each of the preceding embodiments. Therefore, the sensor 33 in this embodiment is far less likely to make a detection error. In this embodiment, the effectiveness of the above-described structural arrangement is affected by where the point of contact between the screw engaging rib 37*a* (37*b*) and the blade 32*b* is in terms of the rotational direction of the screw when the screw 32 stops rotating. However, also in this embodiment, the cover 36*a* (36*b*) is incessantly and rotationally moved in an oscillatory manner while the screw 32 is conveying the toner (FIG. 12). Therefore, the small amount of accumulation of toner on the top side of the cover 36*a* (37*a*) is not a matter of concern. Further, the structural features of the sensor 33 in this embodiment other than the above described one, and the effects of the structural arrangement for the sensor 33 in this embodiment, are the same as those in the first embodiment.

Embodiment 4

Next, referring to FIGS. 13-17, the fourth preferred embodiment of the present invention is described. In this embodiment, the light emitting portion 34 and light sensing portion 35 of the sensor 33 are on the same side wall 31*c* (or 31*d*) of the developer storage portion 31. Further, the light emitting element 34*a* and light sensing element 35*a* are on the same substrate 50. More concretely, the light guide 34*c*' of the light emitting portion 34, and the light guide 35*c*' of the light sensing portion 35, are L-shaped, and are positioned so that the light exit surface 34*b* and light entrance surface 35*b* become roughly parallel to the side wall 31*c* (or 31*d*). Thus, the beam of light emitted from the light emitting element 34*a* in the direction perpendicular to the side wall 31*c* (or 31*d*) is guided by the light guide 34*c*' of the light emitting portion 34, is deflected in the direction parallel to the side wall 31*c* (31*d*), exits through the light exit surface 34*b*, enters the light guide 35'*c* of the light sensing portion 35 through the light entrance surface 35*b*, is guided by the light guide 35*c*', is deflected in the direction perpendicular to the side wall 31*c* (31*d*), and is detected by the light sensing element 35*a*.

In this embodiment, the portion 51 of the light guide 34*c*', which is between the light exit surface 34*b*, and the surface at (by) which the beam of light emitted from the light emitting element 34*a* is deflected, is cylindrical, and so is the portion 51 of the light guide 35*c*', which is between the light entrance surface 35*b*, and the surface at (by) which the beam of light having entered light guide 35*c*' is deflected. Further, the light guide covers 36*a* and 36*b* are fitted around these cylindrical portions 51 and 51 so that they can be rotationally moved around the cylindrical portions 51 and 51. The light entrance surface 34*c*' and light exit surface 35*c*' are the end surfaces of the cylindrical portions 51 and 51, respectively. The sensor 33 in this embodiment has only a single screw engaging rib 52, which is attached to both the peripheral surface of the covers 36*a*, and that of the cover 36*b*, perpendicular to the peripheral surfaces. In other words, the light guide covers 36*a* and 36*b* are connected to each other by the screw engaging rib 52. Further, the screw engaging rib 52 is shaped and positioned so that its tip portion, that is, the portion opposite from its base portion, engages with the blade 32*b* of the screw 32.

Also in this embodiment, the point of engagement between the screw engaging rib 52 and blade 32*b* of the screw 32 is made to shift by the rotation of the screw 32, whereby the light guide covers 36*a* and 36*b* are rotationally moved. Thus, the toner on the covers 36*a* and 36*b* are made to fall by the rotational movement of the covers 36*a* and 36*b*. More concretely, referring to FIG. 16, as the screw 32 is driven when the bodies t of toner are on the covers 36*a* and 36*b*, the blade 32*b* of the screw 32 comes into contact with the screw engaging rib 52, which the covers 36*a* and 36*b* share. Then, as the screw 32 is rotated further, the point of engagement between the screw engaging rib 52 and the blade 32*b* of the screw is made to shift in the direction indicated by an arrow mark T by the rotation of the screw 32. In other words, the screw engaging rib 52 is rotationally moved in the direction indicated by the arrow mark R by the blade 32*b*. Thus, the covers 36*a* and 36*b* are rotationally moved. Consequently, the bodies t of toner on the covers 36*a* and 36*b* fall from the covers 36*a* and 36*b*. Next, as the screw 32 is rotated further, the screw engaging rib 52 is made, by the further rotation of the screw 32, to ride over the peak of the spiral of the blade 32*b*, with which it has been in contact, it rotationally moves in the opposite direction from the direction in which it has been rotationally moved. Consequently, the next spiral of the blade 32*b* comes into contact with the screw engaging rib 52, and the screw engaging rib 52 begins to be rotationally moved by this spiral of the blade 32*b*. This operational sequence is repeated as long as the screw 32 is rotated. Incidentally, it is not mandatory that the screw engaging rib 52 is attached to both the covers 36*a* and 36*b*. That is, the covers 36*a* and 36*b* may be provided with their own screw engaging rib. The structural features of the sensor 33 in this embodiment other than the above-described ones, and their effects, are the same as those in the first embodiment.

Miscellaneous Embodiments

The above-described preferred embodiments of the present invention can be employed in combination as fit. Further, the preceding embodiments were described with reference to the intermediary developer storage device of the developing device of the image forming apparatus which use two-component developer. However, the present invention is also applicable to a developing storing device structured differently from those in the preceding embodiments. For example, the present invention is applicable to an intermediary developer storage device which is structured for single-component developer, has an internal developer conveying means, and detects the presence (or absence) of developer with the use of an optical sensor. That is, the present invention is applicable to an intermediary developer storage device in general, minus the toner delivering portion such as the one described above, whether the intermediary developer storage device is for single-component developer or two-component developer.

In each of the preceding embodiments, the intermediary developer storage device was structured so that each of the light guide covers 36*a* and 36*b* covers virtually the entirety of the peripheral surface of the light guide. However, all that is necessary is that the light cover 36 covers at least the portions of the light guide, which face upstream in terms of the gravity direction and are adjacent to the light exit surface 34*b* or light entrance surface 35*b*. That is, as described above, if the toner having accumulated on the light guide is left unattended for a substantial length of time, the toner grows into a semisolid body of toner, which looks like an icicle. Sometimes, it grows downward large enough to cover the light exit surface 34*b* and light entrance surface 35*b* of the light guides, blocking thereby the light from the light emitting element 34*a*. Thus, as long as the light guide covers 36*a* and 36*b* are shaped, sized, and positioned to cover at least the upwardly facing portions of the surface of the light guide, and the adjacencies of the light exit surface 34*b* and light entrance surface 35*b*, the bodies t of toner on the cover 36*a* or 36*b*, which might grow downward large enough to cover the light exit surface 34*b* and light entrance surface 35*b* can be shaken down by rotationally moving the cover 36*a* and 36*b*. Conceptually, the "adjacencies" of the light exit surface 34*b* and light entrance surface 35*b* includes not only immediate adjacencies of the light exit surface 34*b* and light entrance surface 35*b*, but also, the areas slightly beyond the immediate adjacencies. In essence, the light guide covers 36*a* and 36*b* have only to be shaped, sized, and positioned so that they can be rotationally moved to shake down the bodies of toner on the covers 36*a* and 36*b* in order to prevent the bodies of toner from growing downward large enough to cover the light exit surface and light entrance surface.

As for the driving means for rotationally moving the light guide covers 36*a* and 36*b*, it does not need to be the combination of the screw 32 and screw engaging rib 37*a* (37*b*). That is, the intermediary developer storage device may be structured so that the covers 36*a* and 36*b* are moved with their own driving means. Further, the intermediary developer storage device may be structured so that the force of the motor for driving the screw 32 is transmitted to the covers 36*a* and 36*b* with the use of gears or the like means to drive the covers 36*a* and 36*b*.

Also in each of the preceding preferred embodiments of the present invention, the direction in which the light exit surface 34*b* and light entrance surface 35*b* face each other was roughly horizontal. However, it may be slightly angled relative to the horizontal direction. That is, it has only to intersect with the gravity direction. In a case where the direction in which the light exit surface 34*b* and light entrance surface 35*b* face each other is slightly angled relative to the horizontal direction, the developer sometimes accumulates on the light guide of the light emitting portion of the sensor 33, which guides the light from the light emitting element 34*a* to the light exit surface 34*b*, or the light guide of the light sensing portion of the sensor 33, which guides the light from the light emitting element 34*a*, from the light entrance surface 35*b*. Thus, the present invention is also applicable to this case, with desirable results. However, in a case where the direction in which the light exit surface 34*b* and light entrance surface 35*b* face each other is excessively angled relative to the horizontal direction, the developer directly accumulates one of the two surfaces 34*b* or 35*b*. Therefore, the angle of this direction relative to the horizontal direction is desired to be small enough to make it difficult for the developer to directly accumulate on the surfaces 34*b* or 35*b*.

Also in each of the preceding preferred embodiments, both the light emitting portion and light sensing portion of the light sensor 33 were provided with the light guide. However, it may be only one of the light emitting portion and light sensing portion of the sensor 33 that is provided with the light guide; the other portion of the sensor 33 does not need to be provided with the light guide. That is, the intermediary developer storage device may structured as follows: The light emitting element or light sensing element is buried in one of the side walls of the developer storage portion, and this side wall is provided with the light exit surface or light entrance surface. If it is the light emitting element (light sensing element) that is buried in the side wall, the light guide is positioned between the light exit (entrance) surface of this wall and the light sensing (emitting) portion, and is fitted with the light guide cover.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 165839/2010 filed Jul. 23, 2010 which is hereby incorporated by reference.

What is claimed is:

1. A developer accommodating apparatus comprising:

a developer accommodating portion for accommodating a developer;

developer detecting means, including a light receiving element for receiving light emitted by a light emitter, for detecting the developer in said developer accommodating portion;

a cylindrical light guide member, provided projected from a side surface of said developer accommodating portion, for guiding the light emitted from said light emitter to said light receiving element;

a rotatable member provided concentrically with said cylindrical light guide member and rotatable around said cylindrical light guide member; and driving means for rotating said rotatable member.

2. An apparatus according to claim 1, wherein said driving means includes a screw member for feeding the developer in said developer accommodating portion.

3. An apparatus according to claim 2, wherein said rotatable member includes a plurality of projected engaging portions arranged in a rotational direction such that a projected engaging portion sequentially engages with a blade of said screw member.

4. An apparatus according to claim 1, further comprising a developer receiving opening for receiving the developer from outside of said developer accommodating portion, wherein said developer detecting means is disposed below said developer receiving opening.

5. An apparatus according to claim 1, wherein said rotatable member is provided with a projected engaging portion, projected in a direction substantially perpendicular to an axis of said cylindrical light guide member, for receiving a driving force from said driving means, wherein said rotatable member is swingable by the driving force and a weight of said projected engaging portion.

* * * * *